US008231093B2

(12) United States Patent
Tran

(10) Patent No.: US 8,231,093 B2
(45) Date of Patent: Jul. 31, 2012

(54) BRACKET FOR CURTAIN RODS AND THE LIKE

(76) Inventor: Phillip Tran, Philadelphia, PA (US)

( * ) Notice: Subject to any disclaimer, the term of this patent is extended or adjusted under 35 U.S.C. 154(b) by 194 days.

(21) Appl. No.: 12/718,281

(22) Filed: Mar. 5, 2010

(65) Prior Publication Data

US 2010/0224749 A1 Sep. 9, 2010

Related U.S. Application Data

(60) Provisional application No. 61/158,069, filed on Mar. 6, 2009.

(51) Int. Cl.
*A47H 1/10* (2006.01)

(52) U.S. Cl. ..... 248/262; 248/251; 16/87.2; 211/105.1

(58) Field of Classification Search ..... 248/262, 248/251, 261, 267, 273; 16/87.2; 160/178.1, 160/330, 348; 211/105.1; 428/28
See application file for complete search history.

(56) References Cited

U.S. PATENT DOCUMENTS

| | | | | | |
|---|---|---|---|---|---|
| 722,387 | A | * | 3/1903 | Scott | 248/254 |
| 905,142 | A | * | 12/1908 | Bond | 248/264 |
| 2,374,787 | A | * | 5/1945 | Spiegel et al. | 211/105.1 |
| D217,117 | S | | 4/1970 | Gordon et al. | D8/229 |
| 3,516,631 | A | | 6/1970 | Santucci | 248/71 |
| 3,637,177 | A | | 1/1972 | Santucci | 248/74 PB |
| 3,661,272 | A | * | 5/1972 | Di Panni, Jr. | 211/105.1 |
| 3,942,750 | A | | 3/1976 | Noorily | 248/74 PB |
| 4,132,381 | A | | 1/1979 | McClellan | 248/316 |
| 4,478,381 | A | | 10/1984 | Pittion et al. | 248/71 |
| 4,609,171 | A | | 9/1986 | Matsui | 248/74.3 |
| 4,897,952 | A | | 2/1990 | Hawie | 43/21.2 |
| 5,022,104 | A | * | 6/1991 | Miller | 4/558 |
| D331,189 | S | | 11/1992 | Daigle et al. | D8/396 |
| 5,318,174 | A | * | 6/1994 | Zoroufy | 211/45 |
| 5,385,248 | A | * | 1/1995 | Klein, Jr. | 211/105.1 |
| D356,941 | S | | 4/1995 | Reddick et al. | D8/367 |
| D414,404 | S | | 9/1999 | van de Lande | D8/396 |
| 6,450,233 | B1 | | 9/2002 | Becker | 160/102 |
| 6,561,471 | B1 | | 5/2003 | Hawie | 248/201 |
| 6,595,478 | B2 | * | 7/2003 | Lee | 248/262 |

OTHER PUBLICATIONS

Retrieved from: http://www.kenney.com/pdf/instruction%20sheets/dblrod/dblrodinst060207 on Mar. 5, 2010; "Decorative Double Bracket Rod Set;" publication date unknown; 1 page.

* cited by examiner

*Primary Examiner* — Anita M King
(74) *Attorney, Agent, or Firm* — Mendelsohn, Drucker & Associates, P.C.; Craig M. Brown; Kevin M. Drucker

(57) ABSTRACT

In one embodiment, a bracket for mounting a rod to a surface has a surface-mounting portion and a rod-attachment portion. The surface-mounting portion provides an interface between the bracket and the surface, and attaches to the surface using suitable fasteners such as screws or nails. The rod-attachment portion has an aperture formed therein that accepts a threaded fastener used to attach a finial to the end of the rod. The aperture has a dimension that is smaller than a diameter of the rod, and at least as large as a diameter of the fastener. In one exemplary method of using the bracket, the fastener, attached to the finial, is fed through the aperture into a socket in the rod. The finial is then rotated thereby coupling the finial to the rod until the rod-attachment portion is secured between the rod and the finial.

20 Claims, 2 Drawing Sheets

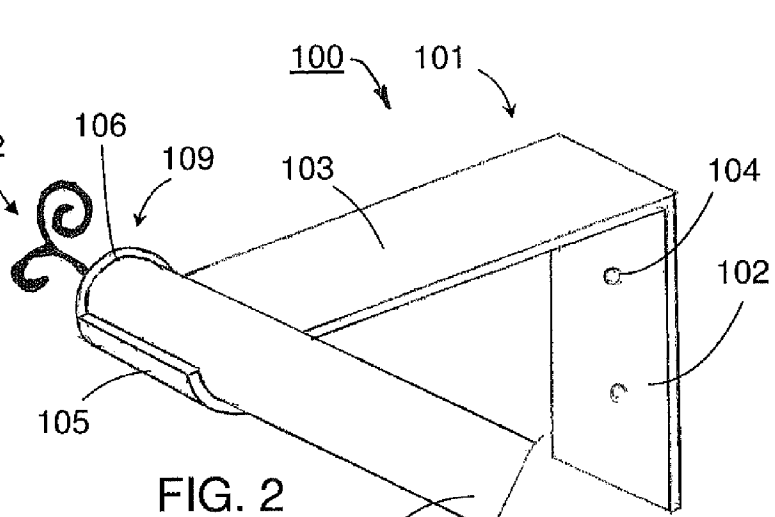
FIG. 1
FIG. 2
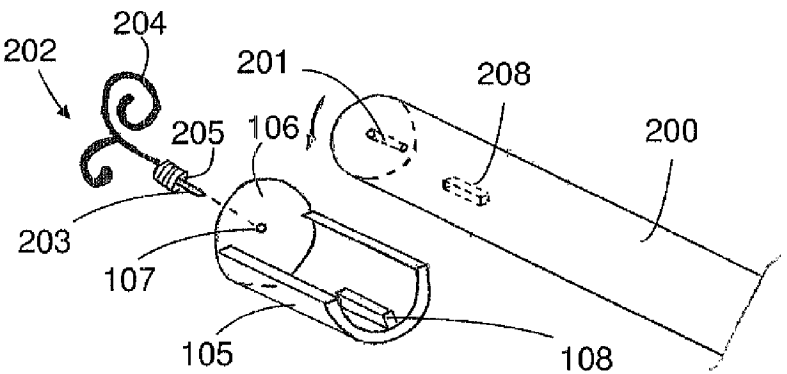
FIG. 3
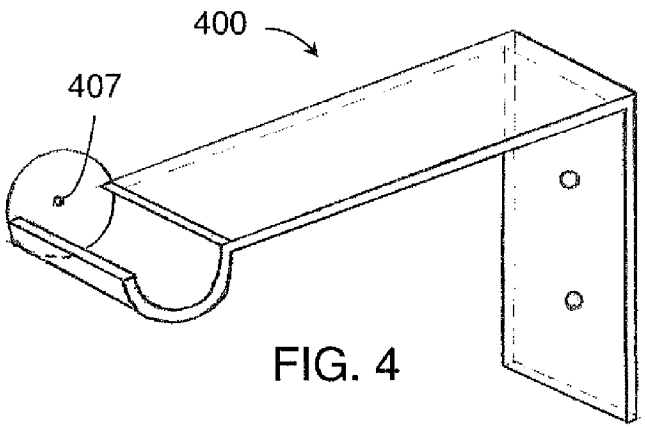
FIG. 4

BRACKET FOR CURTAIN RODS AND THE LIKE

CROSS-REFERENCE TO RELATED APPLICATIONS

This application claims the benefit of the filing date of U.S. provisional application No. 61/158,069, filed on Mar. 6, 2009, the teachings of which are incorporated herein by reference.

BACKGROUND OF THE INVENTION

1. Field of the Invention

The present invention relates to rod-mounting brackets, such as curtain rod-mounting brackets and shower-curtain rod-mounting brackets.

2. Description of the Related Art

Brackets have long been used for mounting curtain rods, shower curtain rods, and other rods to surfaces such as walls, windows, window frames, window casings, and ceilings. These brackets are offered in many different shapes and sizes and range from highly ornamental designs to simpler utilitarian designs. Often, these brackets comprise a hook-like feature in which the rod rests, or a ring through which the rod passes. In some commercial embodiments, the rod is allowed to freely rotate and slide back and forth on the bracket. In other commercial embodiments, the rod is secured by the user screwing a thumb screw through the bracket until it contacts the outer surface of the rod.

SUMMARY OF THE INVENTION

In one embodiment, the present invention is a bracket for mounting a rod onto a surface. The bracket comprises a surface-mounting portion and a rod-attachment portion connected to the surface-mounting portion. The surface-mounting portion provides an interface between the bracket and the surface. An aperture is formed in the rod-attachment portion that accepts a fastener that attaches a finial to the rod. A dimension of the aperture is smaller than a diameter of the rod, such that the rod does not pass through the aperture. Further, the dimension of the aperture is at least as large as a dimension of the fastener, such that a fastening portion of the fastener may pass through the aperture.

In another embodiment, the present invention is a system for mounting a rod onto a surface. The system comprises the rod, a finial, a fastener that attaches the finial to the rod, and a bracket. The bracket comprises a surface-mounting portion and a rod-attachment portion connected to the surface-mounting portion. The surface-mounting portion provides an interface between the bracket and the surface. An aperture is formed in the rod-attachment portion, through which the fastener connects the finial to the rod. A dimension of the aperture is smaller than a diameter of the rod, such that the rod does not pass through the aperture. Further, the dimension of the aperture is at least as large as a dimension of the fastener, such that a fastening portion of the fastener may pass through the aperture.

In yet another embodiment, the present invention is a method for operating a bracket for mounting a rod onto a surface. The bracket comprises a surface-mounting portion and a rod-attachment portion connected to the surface-mounting portion. The surface-mounting portion provides an interface between the bracket and the surface. An aperture is formed in the rod-attachment portion that accepts a fastener that attaches a finial to the rod. A dimension of the aperture is smaller than a diameter of the rod, such that the rod does not pass through the aperture. Further, the dimension of the aperture is at least as large as a dimension of the fastener, such that a fastening portion of the fastener may pass through the aperture. The method comprises the steps of (a) aligning an axis of the rod with an axis of the aperture, (b) aligning an axis of the finial with an axis of the aperture, and (c) securing the rod to the finial using a fastener passed through the aperture.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

FIG. 1 illustrates a three-dimensional view of a bracket for mounting a rod onto a surface according to one embodiment of the present invention;

FIG. 2 illustrates a three-dimensional view of the bracket of FIG. 1 having a rod and a finial installed therein;

FIG. 3 illustrates an exploded view of the installation of the rod and finial of FIG. 2 onto the bracket of FIG. 1;

FIG. 4 illustrates a three-dimensional view of a bracket for mounting a rod onto a surface according to another embodiment of the present invention;

DETAILED DESCRIPTION

Figure 7:
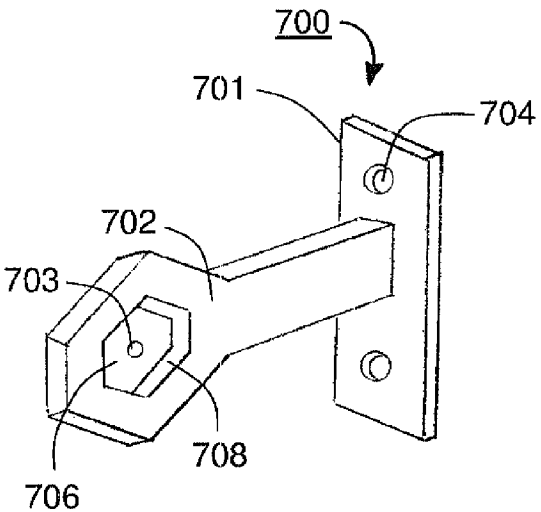
FIG. 7 illustrates a three-dimensional view of a bracket for mounting a rod onto a surface according to even yet another embodiment of the present invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

FIG. 1 illustrates a three-dimensional view of a bracket 100 for mounting a rod onto a surface according to one embodiment of the present invention. Bracket 100 has a surface-mounting portion 101 and a rod-attachment portion 109. Surface-mounting portion 101 is an L-shaped mount, having a first plate 102 and a second plate 103. First plate 102 has one or more through-holes 104 through which a fastener (not shown), such as a screw, nail, or other suitable fastener, may pass to secure bracket 100 to a surface. The surface (not shown) may be a wall, ceiling, window frame, or other suitable mounting surface. Second plate 103 extends perpendicularly from the top of first plate 102 away from the mounting surface. Rod-attachment portion 109, which is oriented on the end of second plate 103 opposite from first plate 102, comprises a rod-stopping portion 106 and a rod-holding portion 105. Rod-stopping portion 106 is a plate formed at one end of rod-holding portion 105 and has aperture 107 (discussed below) formed therein. Rod-holding portion 105, which is shaped to accept a cylindrical rod, has a rotation-restriction component 108 disposed therein. In this embodiment, rotation-restriction component 108 (discussed below) is a block-shaped protrusion. To further understand the operation of bracket 100 consider FIGS. 2 and 3.

FIG. 2 illustrates a three-dimensional view of bracket 100 having a rod 200 and a finial 202 installed therein. FIG. 3 illustrates an exploded view of the installation of rod 200 and finial 202 onto rod-attachment portion 109 of bracket 100. As shown, finial 202 has a threaded portion 203, an end portion 204, and a transition surface 205 located between threaded portion 203 and end portion 204. End portion 204 may have any suitable decorative or non-decorative shape. Rod 200 has a rotation-restriction recess 208, which is a block-shaped recess formed near the end of rod 200 configured to mate with rotation-restriction component 108 of rod-holding portion 105. Rod 200 also has socket 201, which accepts threaded portion 203 of finial 202.

In one exemplary mode of using bracket 100, the user brings rod 200 to rest in rod-holding portion 105 by mating rotation-restriction recess 208 of rod 200 with rotation-restriction component 108 of rod-holding portion 105. The mating of rotation-restriction component 108 and rotation-restriction recess 208 with one another prevents the rod from rotating within rod-holding portion 105. Rod 200 and rod-holding portion 105 are designed such that socket 201 of rod 200 aligns with aperture 107 of end plate 106 when rotation-restriction component 108 and rotation-restriction recess 208 are mated. Next, the user places threaded portion 203 of finial 202 through aperture 107 toward rod 200 until threaded portion 203 is inserted into socket 201 of rod 200. The user then rotates finial 202 to thread finial 202 into socket 201 as far as possible. Note that, in use, bracket 100, which secures one end (i.e., the left end) of rod 200, will often be accompanied by a corresponding bracket (not shown) that (i) secures the other end (i.e., the right end) of rod 200 and (ii) has a configuration that is the mirror image of the configuration of bracket 100. When such corresponding bracket is used, both finial 202, which is used to secure the left end of rod 200, and a corresponding finial (not shown) that is used to secure the right end of rod 200 are rotated or de-rotated to rapidly install or uninstall rod 200.

Aperture 107 is designed to have a diameter that is (i) smaller than the diameter of rod 200, (ii) smaller than the widest portion of transition surface 205 of final 202, which contacts rod-stopping portion 106, and (iii) at least as large as the diameter of threaded portion 203. Sizing the diameter of aperture 107 in such a manner prevents (i) rod 200 from sliding through aperture 107 toward finial 202 and (ii) finial 202 from sliding through aperture 107 toward rod 200. As a result of this sizing, rod-stopping portion 106 is securely held between rod 200 and surface 205 of finial 202 when threaded portion 203 of finial 202 is fully rotated into socket 201.

The configuration of bracket 100 provides several benefits. First, the configuration of bracket 100 permits a user to rapidly install or uninstall rod 200 from bracket 100 without the use of tools or hardware by simply rotating or de-rotating finial 202 from rod 200. Rapidly installing and uninstalling rod 200 may be beneficial, for example, to facilitate the installation or removal of curtains. Second, the size of aperture 107 of rod-stopping portion 106 relative to the size of rod 200 and the size of surface 205 of finial 202 allows rod 200 to be secured to bracket 100 (and consequently to the surface) such that rod 200 moves very little, if at all, relative to the surface. Third, the mating of rotation-restriction component 108 of bracket 100 and rotation-restriction recess 208 of rod 200 prevents rotation of rod 200, thereby allowing the user to rotate finial 202 into rod 200 or de-rotate finial 202 out of rod 200 without using an extra hand to prevent rod 200 from rotating. Fourth, rod-holding portion 105 holds rod 200 in place, freeing the user's hands to insert threaded portion 203 of finial 202 through aperture 107 and into socket 201.

FIG. 4 illustrates a three-dimensional view of a bracket 400 for mounting a rod onto a surface according to another embodiment of the present invention. Bracket 400 is configured in a manner similar to bracket 100. However, bracket 400 is implemented without a rotation-restriction component such as rotation-restriction component 108 in FIG. 1. The corresponding rod (not shown), which can be implemented without a rotation-restriction recess, is secured to bracket 400 solely by rotating a threaded portion of a finial (not shown), such as threaded portion 203 of finial 202, through aperture 407 and into the end of the rod in a manner similar to that discussed above in relation to FIGS. 1 to 3. However, unlike the embodiment shown in FIGS. 1 to 3, an extra hand may be needed to prevent the rod from rotating while the finial is rotated into or out of the rod.

Figure 5:
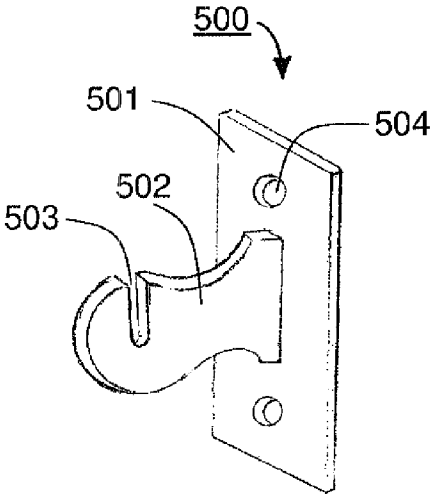
FIG. 5 illustrates a three-dimensional view of a bracket for mounting a rod onto a surface according to yet another embodiment of the present invention.

FIG. 5 illustrates a three-dimensional view of a bracket 500 for mounting a rod onto a surface according to yet another embodiment of the present invention. Bracket 500 has a surface-mounting portion 501 and a rod-attachment portion 502. Surface-mounting portion 501 is a rectangular-shaped plate having one or more through-holes 504 through which a fastener (not shown), such as a screw, nail, or other suitable fastener, may pass to secure bracket 500 to a surface. Rod-attachment portion 502 extends perpendicularly from surface-mounting portion 501 away from the surface and has an aperture (slot) 503 (discussed below). To further understand the operation of bracket 500, consider FIG. 6.

Figure 6:
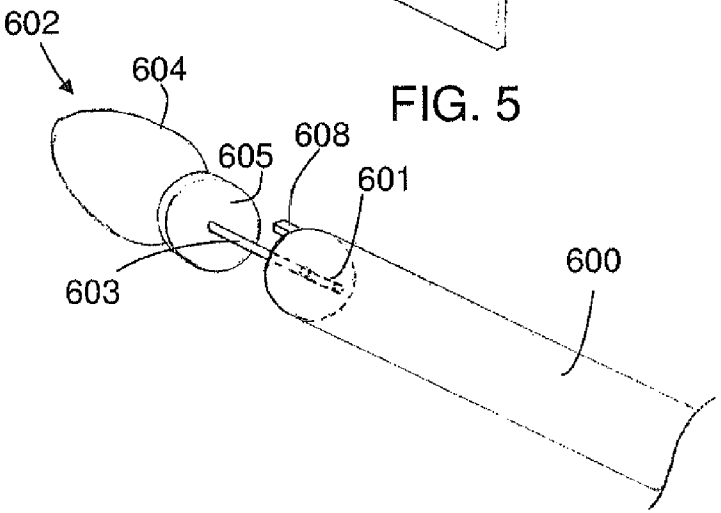
FIG. 6 illustrates an exploded view of a rod and a finial that may be installed onto the bracket of FIG. 5.

FIG. 6 illustrates an exploded view of a rod 600 and a finial 602 that may be installed onto rod-attachment portion 502 of bracket 500. As shown, finial 602 has a threaded portion 603, an end portion 604, and a transition surface 605 located between threaded portion 603 and end portion 604. End portion 604 may have any suitable decorative or non-decorative shape. Rod 600 has a rotation-restriction component 608, which is a protrusion formed on the end of rod 600 configured to mate with aperture 503 of bracket 500. Rod 600 also has socket 601, which accepts threaded portion 603 of finial 602.

In one exemplary mode of using bracket 500, the user couples rod 600 to finial 602 by (i) inserting threaded portion 603 of finial 602 into socket 601 of rod 200 and (ii) rotating finial 602 several turns such that threaded portion 603 is rotated partially but not fully into socket 601. Next, the user slides rod 600 and finial 602 down into aperture 503 such that (i) threaded portion 603 rests in the bottom of aperture 503, (ii) rod-attachment portion 502 is between surface 605 of finial 602 and rod 600, and (iii) rotation-restriction component 608 is inserted into aperture 503. In this embodiment, aperture 503 serves both to hold threaded portion 603 and also serves as a rotation-restriction recess that mates with rotation-restriction component 608. The user then rotates finial 602 to thread finial 602 into socket 601 as far as possible.

Aperture 503 is designed to have a width that is (i) smaller than the diameter of rod 600, (ii) smaller than the widest portion of transition surface 605 of final 602, which contacts rod-attachment portion 502, and (iii) at least as large as the diameter of threaded portion 603. Sizing the diameter of aperture 503 in such a manner prevents (i) rod 600 from sliding through aperture 503 toward finial 602 and (ii) finial 602 from sliding through aperture 503 toward rod 600. As a result of this sizing, rod-attachment portion 502 is securely held between rod 600 and surface 605 of finial 602 when threaded portion 603 of finial 602 is fully rotated into socket 601 of rod 600. Further, rotation-restriction component 608 is designed such that, when inserted into aperture 503, rod 600 does not rotate.

The configuration of bracket 500 provides the several benefits described above in relation to bracket 100 of FIGS. 1 to 3. In addition, the configuration of bracket 500 allows it to be used interchangeably on the right side and left sides of rod 600. This feature may reduce manufacturing costs and manufacturing complexity over brackets that may not be used interchangeably on the right and left sides of the rod. For example, a single manufacturing process may be used to fabricate two copies of bracket 500, which may be used for the right and left sides of rod 600. Two separate manufacturing processes may be needed, on the other hand, to fabricate bracket 100 for the left side of rod 200 and the minor image of bracket 100 for the right side of rod 200. Reducing the number of manufacturing processes may reduce both the complexity and cost of manufacturing.

Although embodiments of the present invention have been described as using a finial (e.g., 202, 602) having a threaded portion (e.g., 203, 603) that is used to couple the finial to a rod (e.g., 200, 600), the present invention is not so limited. The threaded portion and the socket could be reversed, such that the rod comprises the threaded portion and the finial comprises the corresponding socket formed therein for receiving the threaded portion. Alternatively, the threaded portion could be a separate component, and the rod and the finial each could have a corresponding socket formed therein for receiving the threaded portion. The finial could also be coupled to the rod using coupling mechanisms or fasteners other than threaded portion 203 or 603. For example, threaded portion 203 or 603 may be substituted for a protrusion that press fits or snap fits into sockets 201 and 601, respectively.

According to various embodiments of the present invention, the locations of rotation-restriction component (e.g., 108, 608) and rotation-restriction recess (e.g., 208, 503) could vary from the locations described above. For example, in FIG. 3, rotation-restriction component 108 could be located on rod-stopping portion 106 and rotation-restriction recess 208 could be located at the end of rod 200 facing rod-stopping portion 106. As another example, rotation-restriction component 108 and rotation-restriction recess 208 could be switched, such that rotation-restriction component 108 is implemented on rod 200 and rotation-restriction recess 208 is implemented on rod-holding portion 105. According to further embodiments, the configurations of rotation-restriction component 108 and rotation-restriction recess 208 could vary. For example, rotation-restriction component 108 could be implemented as a cylindrical pin-shaped projection that extends perpendicularly from the inner surface of rod-holding portion 105, and rotation-restriction recess 208 could be implemented as a cylindrically shaped recess. As another example, rotation-restriction component 608 of FIG. 6 could be a separable component that is attached to the end of rod 600 using a suitable attachment method such as press-fitting rotation-restriction component 608 into either the end of rod 600 or a cap that is attached to the end of rod 600. According to yet further embodiments, the outer surface of the rod itself could be a rotation-restriction component that mates with a rotation-restriction recess. As an example, consider the embodiment of FIG. 7.

FIG. 7 illustrates a three-dimensional view of a bracket 700 for mounting a rod onto a surface according to even yet another embodiment of the present invention. Bracket 700 has a surface-mounting portion 701 and a rod-attachment portion 702. Surface-mounting portion 701 is a rectangular-shaped plate having one or more through-holes 704 through which a fastener (not shown), such as a screw, nail, or other suitable fastener, may pass to secure bracket 700 to a surface. Rod-attachment portion 702, which extends perpendicularly from surface-mounting portion 701 away from the surface, has a rod-stopping portion 706 and a hexagonally-shaped rotation-restriction recess 708. Rotation-restriction recess 708 extends partially through rod-attachment portion 702 and stops at rod-stopping portion 706. An aperture 703 (discussed below) is formed in the center of rod-stopping portion 706. To further understand the operation of bracket 700, consider FIG. 8.

Figure 8:
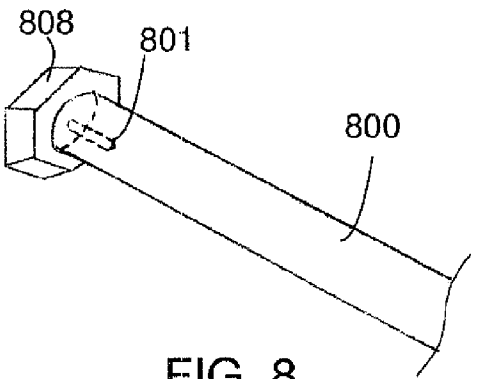
FIG. 8 illustrates a three-dimensional view of a rod that may be used with the bracket of FIG. 7.

FIG. 8 illustrates a three-dimensional view of a rod 800 that may be used with bracket 700 of FIG. 7. Rod 800 has a rotation-restriction component 808, which has a hexagonal shape, and a socket 801 for receiving a threaded portion of a finial (not shown). In one exemplary mode of using bracket 700 and rod 800, the user inserts rotation-restriction component 808 of rod 800 into rotation-restriction recess 708 until rod 800 rests against rod-stopping portion 706. Next, the user inserts the threaded portion of a finial through recess 703 and into socket 801 of rod 800, and rotates the finial as far as possible until rod-stopping portion 706 is secured between rod 800 and the finial.

It will be further understood that various changes in the details, materials, and arrangements of the parts which have been described and illustrated in order to explain the nature of this invention may be made by those skilled in the art without departing from the scope of the invention as expressed in the following claims. For example, brackets of the present invention may be made out of one or more of any suitable materials including metal, wood, and plastic. Brackets of the present invention may also be implemented as a single bracket having no separable components or as a bracket comprising separable components. For example, the rod-attachment portion may be permanently attached to the surface-mounting portion, or the rod-attachment portion may be detachable from the surface-mounting portion. As another example, the surface-mounting portion or the rod-attachment portion may each be constructed of separable components. As yet another example, the rotation-restriction component may be a separable component that is attached to either the rod or the bracket. For example, rotation-restriction component 808 of FIG. 8 may be a separable component that may be attached to the end of rod 800.

The configurations of the rod-attachment portions and surface-mounting portions described herein are merely exemplary. Numerous other configurations for the rod-attachment portions and the surface-mounting portions may be envisioned within the scope of the present invention. Such other configurations may be more decorative than the rod-attachment portions and surface-mounting portions described herein. In such other decorative embodiments, the surface-mounting portions may be more three-dimensional and ornamental than the surface-mounting portions constructed from flat plates described herein. Further, the surface-mounting portions may be constructed of two or more separable components. For example, a first component of a surface-mounting portion may be affixed to a wall using screws, and a second component of the surface-mounting portion that is attached to the rod-attachment portion may be fit over the first component to hide the screws used to mount the first component.

According to various embodiments of the present invention, brackets similar to bracket 100 may be envisioned that may be used interchangeably on the right and left sides of the rod. For example, a bracket similar to bracket 100 could have a rod-holding portion similar to rod-holding portion 105 that is located on both sides of rod-stopping portion 106. Both rod-holding portions may be long enough to hold a rod, but short enough as to not interfere with finial 202.

Brackets of the present invention may be envisioned that hold two or more rods. In such embodiments, one or more of the rods may be secured by coupling a finial to the rod through an aperture as described herein.

Brackets of the present invention may also be envisioned in which the surface-mounting portion is secured to the surface using a fastener other than a screw or nail. For example, brackets of the present invention may be secured to a surface using an adhesive or suction cup.

Brackets of the present invention may also be envisioned in which the aperture is a shape different from the circular or slot shaped apertures shown in FIGS. 1, 3, 5, and 7.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A bracket for mounting a rod onto a surface, the bracket comprising:

a surface-mounting portion that provides an interface between the bracket and the surface;

a rod-attachment portion connected to the surface-mounting portion and with an aperture formed therein, wherein:

the aperture accepts a fastener that attaches a finial to the rod;

a dimension of the aperture is smaller than a diameter of the rod, such that the rod does not pass through the aperture; and the dimension of the aperture is at least as large as a dimension of the fastener, such that a fastening portion of the fastener may pass through the aperture; and a rotation-restriction element that mates with a corresponding rotation-restriction element on the rod to prevent the rod from rotating when installed on the bracket, wherein the rotation-restriction element on the bracket mates with the rotation-restriction element on the rod without turning either the rotation-restriction element on the bracket or the rotation-restriction element on the rod.

2. The bracket of claim 1, wherein:

the rotation-restriction element on the rod is a rotation-restriction recess; and the rotation-restriction element on the bracket is a rotation-restriction component that mates with the rotation-restriction recess on the rod to prevent the rod from rotating when installed on the bracket.

3. The bracket of claim 1, wherein:

the rotation-restriction element on the rod is a rotation-restriction component; and the rotation-restriction element on the bracket is a rotation-restriction recess that mates with the rotation-restriction component on the rod to prevent the rod from rotating when installed on the bracket.

4. The bracket of claim 3, wherein:

an outer surface of the rod forms the rotation-restriction component; and the recess has a shape corresponding to the shape of the outer surface of the rod, wherein the two shapes prevent rotation of the rod when the rod is inserted into the recess.

5. The bracket of claim 3, wherein:

the aperture is a slot in the rod-attachment portion, wherein one edge of the slot is open to accept the fastener and the rotation-restriction component of the rod.

6. The bracket of claim 1, wherein the dimension of the aperture is smaller than a dimension of the finial, such that the finial cannot pass through the aperture.

7. The bracket of claim 1, wherein the aperture is circular in shape, and the dimension is a diameter of the aperture.

8. The bracket of claim 1, wherein the fastening portion of the fastener is threaded.

9. The bracket of claim 1, wherein the rod-attachment portion comprises a rod-stopping portion that prevents the rod from extending past the rod-stopping portion along an axis of the rod, wherein the aperture is formed in the rod-stopping portion.

10. The bracket of claim 9, wherein the rod-attachment portion further comprises a rod-holding portion adapted to support the rod.

11. The bracket of claim 10, wherein the rod-holding portion comprises a rotation-restriction component that mates with a rotation-restriction recess on the rod to prevent the rod from rotating when installed on the bracket.

12. The bracket of claim 10, wherein a top of the rod-holding portion is open such that the rod may be dropped into the rod-holding portion.

13. The bracket of claim 1, wherein the rod-attachment portion comprises:

a rod-stopping portion that prevents the rod from extending past the rod-stopping portion along an axis of the rod, wherein the aperture is formed in the rod-stopping portion; and a rod-holding portion adapted to support the rod, wherein:

a top of the rod-holding portion is open such that the rod may be dropped into the rod-holding portion; and the rod-holding portion comprises the rotation-restriction element that mates with the rotation-restriction element on the rod, wherein:

the rotation-restriction element on the rod is a rotation-restriction recess; and the rotation-restriction element on the bracket is a rotation-restriction component that mates with the rotation-restriction recess on the rod to prevent the rod from rotating when installed on the bracket.

14. A system for mounting a rod onto a surface, the system comprising:

a rod;

a finial;

a fastener that attaches the finial to the rod; and a bracket that comprises:

a surface-mounting portion that provides an interface between the bracket and the surface;

a rod-attachment portion connected to the surface-mounting portion and with an aperture formed therein, wherein:

a dimension of the aperture is smaller than a diameter of the rod, such that the rod does not pass through the aperture;

the dimension of the aperture is at least as large as a dimension of the fastener, such that a fastening portion of the fastener may pass through the aperture; and the fastener connects the finial to the rod through the aperture in the bracket; and a rotation-restriction element that mates with a corresponding rotation-restriction element on the rod to prevent the rod from rotating when installed on the bracket, wherein the rotation-restriction element on the bracket mates with the rotation-restriction element on the rod without turning either the rotation-restriction element on the bracket or the rotation-restriction element on the rod.

15. The system of claim 14, wherein:

the rotation-restriction element on the rod is a rotation-restriction recess; and the rotation-restriction element on the bracket is a rotation-restriction component that mates with the rotation-restriction recess on the rod to prevent the rod from rotating when installed on the bracket.

16. The invention system of claim 14, wherein:

the rotation-restriction element on the rod is a rotation-restriction component; and the rotation-restriction element on the bracket is a rotation-restriction recess that mates with the rotation-restriction component on the rod to prevent the rod from rotating when installed on the bracket.

17. The system of claim 14, wherein the rod-attachment portion further comprises a rod-holding portion adapted to support the rod, wherein a top of the rod-holding portion is open such that the rod may be dropped into the rod-holding portion.

18. The system of claim 14, wherein the rod-attachment portion comprises:

a rod-stopping portion that prevents the rod from extending past the rod-stopping portion along an axis of the rod, wherein the aperture is formed in the rod-stopping portion; and a rod-holding portion adapted to support the rod, wherein:

a top of the rod-holding portion is open such that the rod may be dropped into the rod-holding portion; and the rod-holding portion comprises the rotation-restriction element that mates with the rotation-restriction element on the rod, wherein:

the rotation-restriction element on the rod is a rotation-restriction recess; and the rotation-restriction element on the bracket is a rotation-restriction component that mates with the rotation-restriction recess on the rod to prevent the rod from rotating when installed on the bracket.

19. A method for operating a bracket for mounting a rod onto a surface, the bracket comprising:

a surface-mounting portion that provides an interface between the bracket and the surface;

a rod-attachment portion connected to the surface-mounting portion and with an aperture formed therein, wherein:

the aperture accepts a fastener that attaches a finial to the rod;

a dimension of the aperture is smaller than a diameter of the rod, such that the rod does not pass through the aperture; and the dimension of the aperture is at least as large as a dimension of the fastener, such that a fastening portion of the fastener may pass through the aperture; and a rotation-restriction element that mates with a corresponding rotation-restriction element on the rod to prevent the rod from rotating when installed on the bracket, wherein the rotation-restriction element on the bracket mates with the rotation-restriction element on the rod without turning either the rotation-restriction element on the bracket or the rotation-restriction element on the rod, wherein the method comprises:

(a) aligning an axis of the rod with an axis of the aperture;

(b) aligning an axis of the finial with an axis of the aperture; and (c) securing the rod to the finial using a fastener passed through the aperture.

20. The method of claim 19, wherein the rod-attachment portion further comprises a rod-holding portion adapted to support the rod, wherein a top of the rod-holding portion is open such that the rod may be dropped into the rod-holding portion.

* * * * *